US008230860B2

(12) United States Patent
Dankert et al.

(10) Patent No.: US 8,230,860 B2
(45) Date of Patent: Jul. 31, 2012

(54) FILTER FOR A BREATHING DEVICE

(75) Inventors: Sandra Dankert, Reinfeld (DE); Michael Rosert, Timmendorfer Strand (DE); Dirk Feil, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1107 days.

(21) Appl. No.: 12/123,738

(22) Filed: May 20, 2008

(65) Prior Publication Data

US 2008/0289632 A1 Nov. 27, 2008

(30) Foreign Application Priority Data

May 23, 2007 (DE) ..... 10 2007 023 959

(51) Int. Cl.
*A62B 18/08* (2006.01)

(52) U.S. Cl. ..... 128/206.17

(58) Field of Classification Search ..... 128/206.12, 128/206.17, 201.13, 201.25, 205.27, 205.29, 128/206.16, 206.27, 205.39, 201.22, 201.23, 128/205.28, 206.15, 206.19 C; 95/273
See application file for complete search history.

(56) References Cited

U.S. PATENT DOCUMENTS

| | | | | | |
|---|---|---|---|---|---|
| 2,142,064 | A * | 12/1938 | Whipple | ..... | 128/206.16 |
| 2,205,368 | A * | 6/1940 | Whipple | ..... | 128/206.16 |
| 2,295,119 | A * | 9/1942 | Robert et al. | ..... | 128/206.17 |
| 3,750,665 | A * | 8/1973 | Stranicky | ..... | 128/206.12 |
| 4,038,979 | A * | 8/1977 | McCosker | ..... | 128/206.12 |
| 5,732,695 | A * | 3/1998 | Metzger | ..... | 128/206.12 |
| 5,992,414 | A * | 11/1999 | Tayebi et al. | ..... | 128/205.27 |
| 6,016,804 | A * | 1/2000 | Gleason et al. | ..... | 128/206.17 |
| 6,047,698 | A * | 4/2000 | Magidson et al. | ..... | 128/207.12 |
| 6,161,540 | A * | 12/2000 | Fecteau | ..... | 128/205.27 |
| 2001/0054424 | A1 * | 12/2001 | Salapow et al. | ..... | 128/206.17 |
| 2004/0118399 | A1 * | 6/2004 | Young et al. | ..... | 128/203.15 |
| 2004/0226563 | A1 * | 11/2004 | Xu et al. | ..... | 128/206.21 |
| 2005/0121029 | A1 * | 6/2005 | Reisman | ..... | 128/201.22 |
| 2005/0252510 | A1 * | 11/2005 | Young et al. | ..... | 128/203.12 |
| 2006/0081249 | A1 * | 4/2006 | Duxbury | ..... | 128/205.27 |

* cited by examiner

*Primary Examiner* — Loan Thanh
*Assistant Examiner* — Shila Jalalzadeh Abyane
(74) *Attorney, Agent, or Firm* — McGlew and Tuttle, P.C.

(57) ABSTRACT

A filter for a breathing device is flexible and can be manufactured in a simple manner. The filter includes a flexible frame (5) with a filter port (8) and with an end piece (9). The flexible frame (5) is provided between two filter mats (2, 3). The flexible frame (5) can be folded over along a bent edge (7) such that the filter port (8) and the second end piece (9) are arranged opposite each other.

18 Claims, 3 Drawing Sheets

FILTER FOR A BREATHING DEVICE

CROSS REFERENCE TO RELATED APPLICATIONS

This application claims the benefit of priority under 35 U.S.C. §119 of German Patent Application DE 10 2007 023 959.0 filed May 23, 2007, the entire contents of which are incorporated herein by reference.

FIELD OF THE INVENTION

The present invention pertains to a filter for a breathing device in the form of a breathing mask.

BACKGROUND OF THE INVENTION

A breathing mask with removable filter is known from U.S. Pat. No. 5,732,695. A rigid frame, which has spacers arranged in a spoke-like pattern and a ring extending circumferentially on the outside, which is connected to the spacers, is provided as the carrier for the filter material. The frame has a connection adapter, with which the filter can be connected to the breathing mask. Both sides of the frame are lined with filter material, through which the breathing air enters the interior space of the filter, which interior space is formed by the spacers.

Even though the rigid frame has the advantage that the filter can be easily grasped and can be connected to the mask, the supporting properties of the breathing mask are compromised by the rigid filter frame, because shocks on the filter act directly on the breathing mask and the latter may slip as a result on the face of the mask user. In addition, the prior-art filter requires precise filter blanks, because these must be connected sealingly to the frame in the area of both the filter port and of the circumferential ring. Thus, small deviations in dimension of the filter blanks may lead to leaks at the connection seams. To obtain acceptable resistances to breathing, the spokes of the frame must be dimensioned such that the filter blanks of the front and rear sides of the frame do not touch each other. A slight vacuum is generated in the interior space of the filter during breathing in and a contact may develop in case the distance between the filter blanks is too small, as a result of which the passage area of the filter is reduced.

SUMMARY OF THE INVENTION

The basic object of the present invention is to provide a filter that is flexible and can be manufactured in a simple manner.

According to the invention, a filter is provided for a breathing device. The filter comprises a front filter mat and a rear filter mat. The front filter mat and the rear filter mat have essentially equal surface areas and are joined together along a circumference at a sealing edge. A flexible frame is provided between the front filter mat and the rear filter mat. The flexible frame defines an interior space. The flexible frame has a first end piece with a filter port, through which the interior space is accessible, and has a second end piece at an opposite end of the frame. The frame comprises a one-piece frame structure that can be folded over about a bent edge such that the first end piece and the second end piece are arranged opposite each other in such a manner that the first end piece and the second end piece keep the filter mats apart.

A compression spring may be provided for maintaining the first end piece and the second end piece at spaced locations from each other. The compression spring may be provided between the first end piece and the second end piece.

A connection area may be located in the interior space between the end pieces, the connection area comprising a sealing surface.

The second end piece may have a circular design with a centrally arranged first opening.

The front filter mat may comprise a printable cover mat and an activated carbon absorbent located under the printable cover mat and the rear filter mat may comprise a printable cover mat and an activated carbon absorbent located under the printable cover mat.

The advantage of the present invention is that the filter mats, which have essentially equal surface areas, are directly welded to one another at the circumference and the interior space between the filter mats is defined by the flexible frame, which can be folded over about a bent edge and whose end pieces keep the filter mats apart. One of the end pieces is designed as a filter port and the other end piece is positioned in the interior space opposite the filter port.

The compression spring is advantageously arranged between the filter port and the second end piece such that it keeps the filter mats apart. The filter mats receive a prestress acting from the inside due to the compression spring, so that they are arched convexly towards the outside and there is a sufficient distance between the filter mats at any point.

The connection area located on the inside between the filter port and the second end piece is advantageously designed as a sealing surface and the second end piece has a circular shape and has a first opening arranged centrally. The first opening, combined with the sealing surface, makes it possible to test the tightness of the breathing device. To do so, the user presses the second end piece from the outside, so that the user closes the first opening with the ball of his or her thumb. The sealing surface of the second end piece is now in contact with the filter port and the path of gas into the interior space of the filter is closed. By closing the first opening by means of the ball of the user's thumb, the filter is sealed against the environment. A certain vacuum is generated at the filter port during heavy breathing by the user and the tightness of the breathing device can thus be tested in the area of the filter port.

The filter mats advantageously consist of a printable covering mat with subjacent filter materials consisting of activated carbon. The absorption layers of the filter now advantageously lie on one another layer by layer.

An exemplary embodiment of the present invention is shown in the figures and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
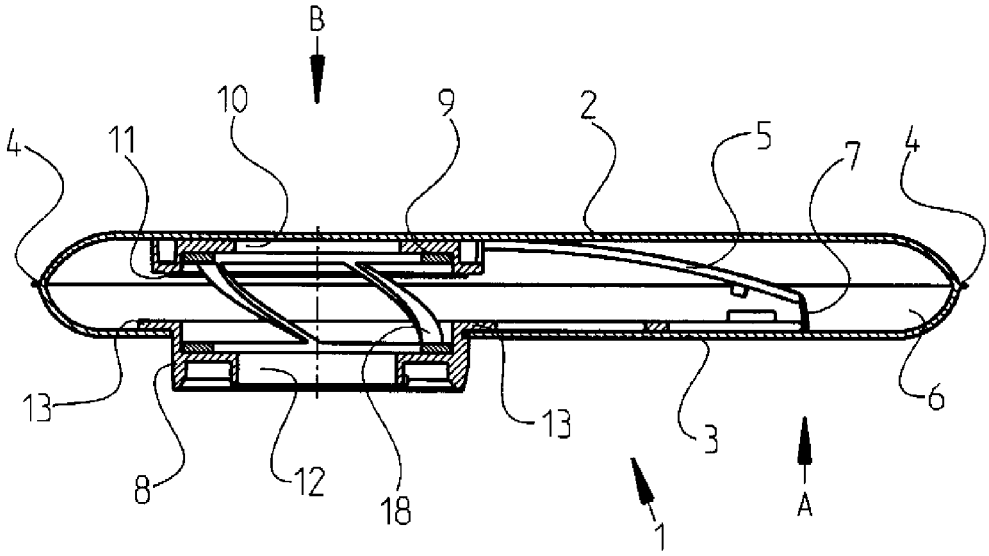
FIG. 1 is a longitudinal sectional view of a filter according to the present invention.
Figure 5A:
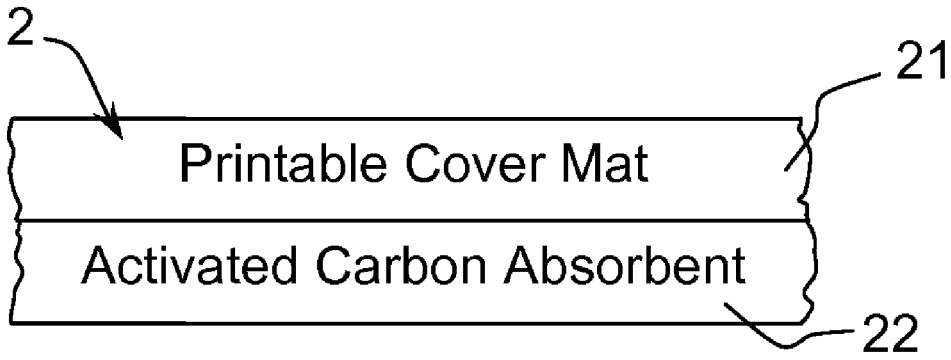
FIG. 5A is a schematic sectional view of a front filter mat comprising a printable cover mat and an activated carbon absorbent.
Figure 5B:
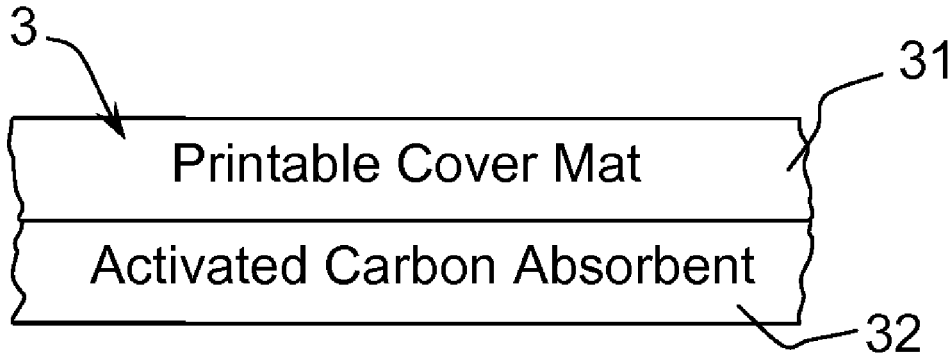
FIG. 5B is a schematic sectional view of a rear filter mat comprising a printable cover mat and an activated carbon absorbent.

Referring to the drawings in particular, FIG. 1 illustrates a longitudinal section of a filter 1 according to the present invention. The filter 1 comprises a front filter mat 2 and a rear filter mat 3, which are welded to one another along the circumference at a sealing edge 4 of a flexible frame 5 in the interior space 6 between the filter mats 2, 3, which is folded over at a bent edge 7. As shown in FIG. 5A the front filter mat 2 mat may comprise a printable cover mat 21 and an activated carbon absorbent 22 located under the printable cover mat 21 and as shown in FIG. 5B the rear filter mat 3 may comprise a printable cover mat 31 and an activated carbon absorbent 32 located under the printable cover mat. The frame 5 has, at its first end piece, a filter port 8 for connection to a breathing mask, not shown in FIG. 1, and a second end piece 9 arranged opposite the filter port 8. The second end piece 9 has a centrally arranged first opening 10, which is covered by the front filter mat 2. The second end piece is provided with a sealing surface 11 on its side facing the filter port 8. A compression spring 18, which keeps the filter mats 2, 3 apart, is located between the filter port 8 and the second end piece 9. A second opening 12 arranged in the filter port 8 establishes the gas connection from the interior space 6 of the filter 1 to a breathing mask, not shown more specifically in FIG. 1. The filter port 8 is provided with a circularly extending contact surface 13 for connection to the rear filter mat 3.

The filter 1 also makes it possible to test the tightness of the breathing device, not shown more specifically in FIG. 1. To do so, the user presses the second end piece 9 from the outside along arrow "B," so that the user closes the first opening 10 with the ball of the user's hand. The sealing surface 11 of the second end piece 9 is now in contact with the filter port 8, and the path of gas from the second opening 12 into the interior space 6 is closed. A certain vacuum is generated at the filter port 8 during breathing in by the user, and the tightness of the filter port 8 of the breathing device can thus be tested.

Figure 2:
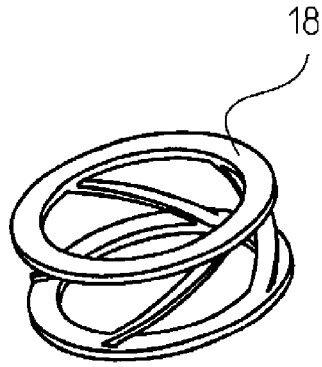
FIG. 2 is a perspective view of a compression spring of the filter according to the present invention.

FIG. 2 illustrates the compression spring 18 according to FIG. 1 in a perspective view.

Figure 3:
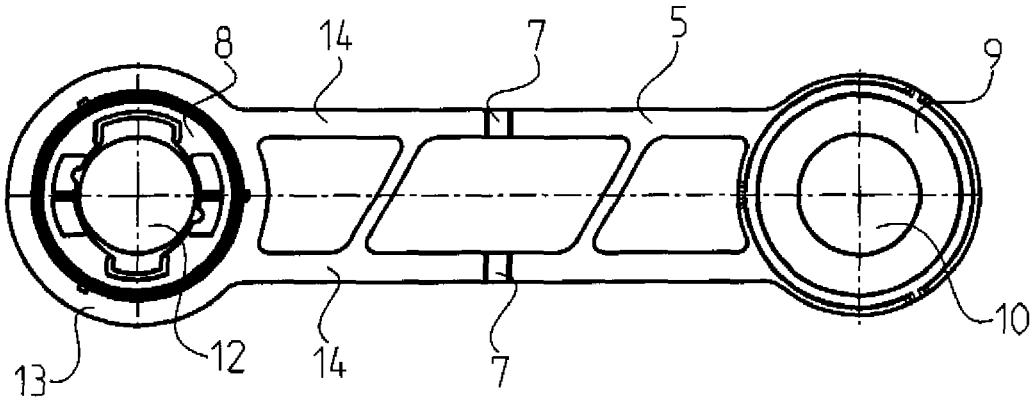
FIG. 3 is a top view of the frame of the filter according to FIG. 1.
Figure 4:
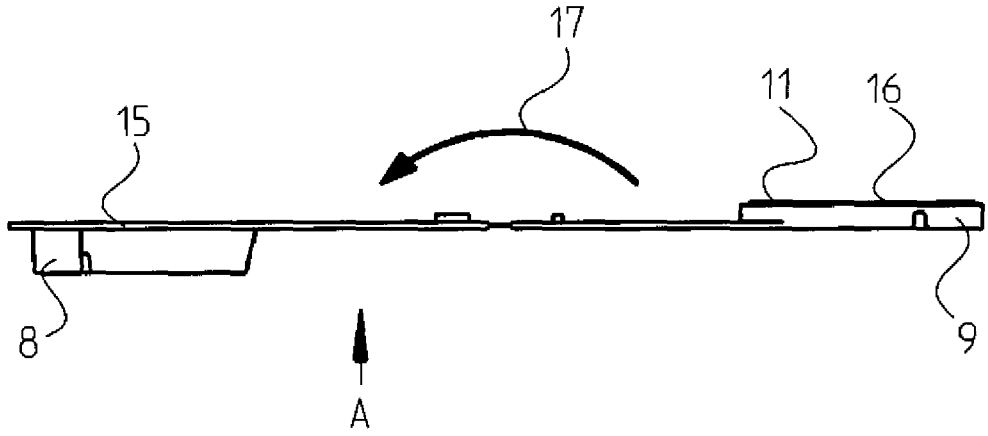
FIG. 4 is a side view of the frame according to FIG. 3.

FIG. 3 shows the holder 5 as an individual part in view "A" according to FIG. 4 or the individual part in view "A" according to FIG. 1 but in an open state. Identical components are designated by the same reference numbers as in FIG. 1. The filter port 8 and the second end piece 9 are connected to one another via a band-like plastic part. The bent edge 7 is arranged such that the filter port 8 and the second end piece 9 lie one on top of another in the folded state.

FIG. 4 shows a view of the holder 5 rotated forward by 90° in relation to FIG. 3. Depressions 15, 16 are provided at the filter port 8 and at the second end piece 9 for receiving the compression spring 18, which fix the compression spring 18 and prevent it from falling out. Arrow 17 illustrates the pivoting direction of the second end piece 9 in relation to the filter port 8 during mounting.

While a specific embodiment of the invention has been shown and described in detail to illustrate the application of the principles of the invention, it will be understood that the invention may be embodied otherwise without departing from such principles.

What is claimed is:

1. A filter for a breathing device, the filter comprising:

a front filter mat;

a rear filter mat, said front filter mat and said rear filter mat having essentially equal surface areas and being joined together along a circumference at a sealing edge;

a flexible frame between said front filter mat and said rear filter mat, said flexible frame defining an interior space, said flexible frame having a first end piece with a filter port, through which said interior space is accessible, and having a second end piece at an opposite end of said flexible frame, said flexible frame comprising a one-piece frame structure that can be folded over about a bent edge such that said first end piece and said second end piece are arranged opposite each other in such a manner that said first end piece and said second end piece keep said filter mats apart.

2. A filter in accordance with claim 1, further comprising a compression spring for maintaining said first end piece and said second end piece at spaced locations from each other, said compression spring being provided between said first end piece and said second end piece.

3. A filter in accordance with claim 1, wherein a connection area is located in said interior space between said first end piece and said second end piece, said connection area comprising a sealing surface.

4. A filter in accordance with claim 1, wherein said second end piece has a circular design with a centrally arranged first opening.

5. A filter in accordance with claim 1, wherein said front filter mat comprises a printable cover mat and an activated carbon absorbent located under said printable cover mat.

6. A filter in accordance with claim 1, wherein said rear filter mat comprises a printable cover mat and an activated carbon absorbent located under said printable cover mat.

7. A filter for a breathing device, the filter comprising:

a flexible frame having a first end piece with a filter port and having a second end piece at an opposite end of said flexible frame, said flexible frame comprising a one-piece frame structure that is folded over about a bent edge such that said first end piece and said second end piece are arranged opposite each other and said flexible frame defines an interior space, said filter port providing a passage through which said interior space is accessible;

a front filter mat; and a rear filter mat, said front filter mat and said rear filter mat having essentially equal surface areas and being joined together along a circumference at a sealing edge, said folded flexible frame being positioned between said front filter mat and said rear filter mat in such a manner that said first end piece and said second end piece keep said filter mats apart.

8. A filter in accordance with claim 7, further comprising a compression spring for maintaining said first end piece and said second end piece at spaced locations from each other, said compression spring being provided between said first end piece and said second end piece.

9. A filter in accordance with claim 7, wherein a connection area is located in said interior space between said first end piece and said second end piece, said connection area comprising a sealing surface.

10. A filter in accordance with claim 7, wherein said second end piece has a circular design with a centrally arranged first opening.

11. A filter in accordance with claim 7, wherein said front filter mat comprises a printable cover mat and an activated carbon absorbent located under said printable cover mat.

12. A filter in accordance with claim 7, wherein said rear filter mat comprises a printable cover mat and an activated carbon absorbent located under said printable cover mat.

13. A filter for a breathing device, the filter comprising:

a front filter mat comprising filter material;

a rear filter mat comprising filter material, said front filter mat having a front filter mat surface area with a peripheral edge and said rear filter mat having a rear filter mat surface area with a peripheral edge, said front filter mat peripheral edge being joined to said rear filter mat peripheral edge to form a sealing edge, said front filter mat joined to said rear filter mat defining a gas filtration path with gas passing through said front filter mat surface area being filtered by said filter material of said front filter mat and gas passing through said rear filter mat surface area being filtered by said filter material of said rear filter mat;

a flexible frame between said front filter mat and said rear filter mat, said flexible frame maintaining said front filter mat surface area apart from said rear surface mat surface area and defining an interior space between said front filter mat and said rear filter mat, said flexible frame having a first end piece with a filter port providing anon-filtered gas path to said interior space, and having a second end piece at an opposite end of said flexible frame, said flexible frame comprising a one-piece frame structure that is folded over about a bent edge such that said first end piece and said second end piece are arranged opposite each other.

14. A filter in accordance with claim 13, further comprising a compression spring for maintaining said first end piece and said second end piece at spaced locations from each other, said compression spring being provided between said first end piece and said second end piece.

15. A filter in accordance with claim 13, wherein a connection area is located in said interior space between said first end piece and said second end piece, said connection area comprising a sealing surface.

16. A filter in accordance with claim 13, wherein said second end piece has a circular design with a centrally arranged first opening.

17. A filter in accordance with claim 13, wherein said front filter mat comprises a printable cover mat and an activated carbon absorbent located under said printable cover mat.

18. A filter in accordance with claim 13, wherein said rear filter mat comprises a printable cover mat and an activated carbon absorbent located under said printable cover mat.

* * * * *